US009324267B2

(12) United States Patent
In et al.

(10) Patent No.: US 9,324,267 B2
(45) Date of Patent: Apr. 26, 2016

(54) ORGANIC LIGHT EMITTING DISPLAY AND DRIVING METHOD THEREOF

(71) Applicant: Samsung Display Co., Ltd., Yongin, Gyeonggi-do (KR)

(72) Inventors: Hai-Jung In, Yongin (KR); Yong-Sung Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 54 days.

(21) Appl. No.: 13/901,424

(22) Filed: May 23, 2013

(65) Prior Publication Data

US 2014/0240304 A1 Aug. 28, 2014

(30) Foreign Application Priority Data

Feb. 27, 2013 (KR) ..... 10-2013-0021303

(51) Int. Cl.
*G09G 5/00* (2006.01)
*G09G 3/32* (2016.01)

(52) U.S. Cl.
CPC ..... *G09G 3/3233* (2013.01); *G09G 2330/08* (2013.01); *G09G 2330/10* (2013.01)

(58) Field of Classification Search
None
See application file for complete search history.

(56) References Cited

U.S. PATENT DOCUMENTS

2006/0145960 A1* 7/2006 Koga et al. ..... 345/76
2006/0279499 A1* 12/2006 Park et al. ..... 345/92
2007/0040794 A1* 2/2007 Kwak et al. ..... 345/100
2007/0262934 A1* 11/2007 Fujikawa et al. ..... 345/82
2009/0015572 A1* 1/2009 Matsui ..... 345/204
2010/0044691 A1 2/2010 Hong et al.
2010/0078643 A1* 4/2010 Kimura ..... 257/59
2010/0207106 A1 8/2010 Lhee et al.
2011/0169805 A1* 7/2011 Yamazaki ..... 345/211
2012/0120036 A1* 5/2012 Yamashita et al. ..... 345/205
2012/0146034 A1 6/2012 Hong et al.
2012/0212475 A1* 8/2012 Tajika et al. ..... 345/212
2012/0300165 A1* 11/2012 Zhuang et al. ..... 349/139

FOREIGN PATENT DOCUMENTS

KR 10-2002-0040112 A 5/2002
KR 10-2006-0005012 A 1/2006
KR 10-2006-0029077 A 4/2006
KR 10-0932989 B1 12/2009
KR 10-1022156 B1 3/2011
KR 10-1156447 B1 6/2012

* cited by examiner

*Primary Examiner* — Adam R Giesy
*Assistant Examiner* — Henok Heyi
(74) *Attorney, Agent, or Firm* — Knobbe Martens Olson & Bear LLP

(57) ABSTRACT

An organic light emitting display including a repair circuit is disclosed. In one aspect the organic light emitting diode (OLED) display includes a pixel unit having a plurality of pixels positioned at the intersection of scanning lines, data lines, and power lines, The OLED display further includes an organic light emitting diode OLED connected to the pixel circuit, and repair lines disposed in parallel with data lines and repair circuits connected to the repair lines and the power lines. The OLED display further includes a switching unit for selectively connecting output lines of the data driving unit to the repair lines or the data lines.

16 Claims, 5 Drawing Sheets

ORGANIC LIGHT EMITTING DISPLAY AND DRIVING METHOD THEREOF

CROSS-REFERENCE TO RELATED APPLICATIONS

This application claims priority to and the benefit of Korean Patent Application No. 10-2013-0021303, filed on Feb. 27, 2013, in the Korean Intellectual Property Office, the entire content of which is incorporated herein by reference. Any and all priority claims identified in the Application Data Sheet, or any correction thereto, are hereby incorporated by reference under 37 CFR 1.57.

BACKGROUND OF THE INVENTION

1. Field

The present disclosed technology relates to an organic light emitting display and a driving method thereof. More particularly, the present disclosed technology relates to an organic light emitting diode (OLED) display including a repair circuit.

2. Description of the Related Technology

Recently, various flat panel display devices which provide reduced weight and volume, compared to cathode ray tube display devices, have been developed. Typical flat panel display device technologies include liquid crystal displays, field emission displays, plasma display panels, OLED displays, and the like.

Among such technologies, the OLED display, which displays an image using an OLED to generate light by recombination of electrons and holes, has a fast response speed and is driven at a low power.

Generally, an OLED is classified into one of a passive matrix OLED and an active matrix OLED (AMOLED). AMOLED displays include a plurality of scanning lines, a plurality of data lines, and a plurality of power lines, and a plurality of pixels arranged in a matrix form to be connected to the plurality of scanning line, the plurality of data lines, and the plurality of power lines. Each of the pixels includes the organic light emitting diode and a pixel circuit for supplying a driven current corresponding to data signal to the organic light emitting diode. Since the AMOLED as described above has low power consumption, the range of use of the organic light emitting display has gradually increased. However, defects may occur in the pixel circuit such that a yield is deteriorated.

SUMMARY OF CERTAIN INVENTIVE ASPECTS

An object of the present disclosed technology is to provide an organic light emitting display including a repair circuit in order to improve a pixel defect and a driving method thereof.

In one aspect, An organic light emitting diode display, comprising a pixel unit comprising a plurality of pixels positioned at the intersection of scan lines, data lines, and power lines, wherein each of the pixels comprises a pixel circuit connected to a corresponding scan line, data line, and power line, and an organic light emitting diode; repair lines disposed in parallel with plurality of data lines; repair circuits connected to the repair lines and the power lines; a scanning driving unit for supplying a scanning signal to the scanning lines; a data driving unit for supplying a data signal to the data lines, a switching unit for selectively connecting output lines of the data driving unit to the repair lines or to the data lines.

In some embodiments, each of the repair circuits includes a transistor, wherein a gate electrode of the transistor is connected to a corresponding repair line, a first electrode of the transistor is connected to a corresponding power line, and a second electrode of the transistor is connected to the organic light emitting diode.

In some embodiments, the switching unit is configured to electrically separate the pixel circuit from the data driving unit when a defect is present in the pixel In some embodiments, when a defect is present in the pixel, the switching unit is further configured to connect the organic light emitting diode to an adjacent repair circuit.

In some embodiments, the switching unit comprises switches configured to selectively connecting each output line of the data driving unit to the repair line or the data line, during an initial portion of a non-light emitting period and during initial portion of a light-emitting period of the pixel.

In some embodiments, the data driving unit is configured to output a power supply voltage during the initial portion of the non-light emitting period of the pixel and is configured to output a data signal to the output line during the initial portion of the light-emitting period of the pixel.

In some embodiments, the switching unit comprises first switches configured to controlling a connection between the power line and the corresponding repair line, and second switches for selectively connecting each output line of the data driving unit to either the repair line or the data line of the corresponding column.

In some embodiments, if a defect exists in the pixel, the first switches of the column are configured to connect the power supply voltage to the repair line during the non-light emitting period of the pixel, and the second switches are configured to connect the output line of the data driving unit to the repair line during the initial portion of the light emitting period of the pixel, and to connect the output line of the data driving unit to the data line during the remaining portion of the light-emitting period.

In some embodiments, the data driving unit is configured to output a data signal of the pixel during the initial period of the light-emitting period of the pixel.

In some embodiments, the same number of repair circuits as there are pixels in the display device, each repair circuit corresponding to one pixel.

In some embodiments, the display device comprises one repair circuits for a group of more than one pixels, the group sharing the one repair circuit.

In some embodiments, the pixels sharing the one repair circuit are disposed in the same column.

In another aspect, a method of driving an organic light emitting display by connecting an organic light emitting diode of a pixel in which defect has occurred comprises providing a repair circuit comprising a transistor connected between a first pixel power and the organic light emitting diode; applying a voltage to the gate electrode of the transistor sufficient to turn off the transistor during a non-light emitting period of the pixel; and applying a signal voltage to the gate electrode of the transistor corresponding to a data signal of the pixel during a light-emitting period of the pixel.

In some embodiments, the method further comprises applying a power supply voltage to the repair line during at least an initial period of the non-light emitting period, In some embodiments, the power supply voltage is sufficient to turn off the transistor.

In some embodiments, the method further comprises applying the data signal to the repair line during at least an initial period of the light-emitting period of the pixel.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
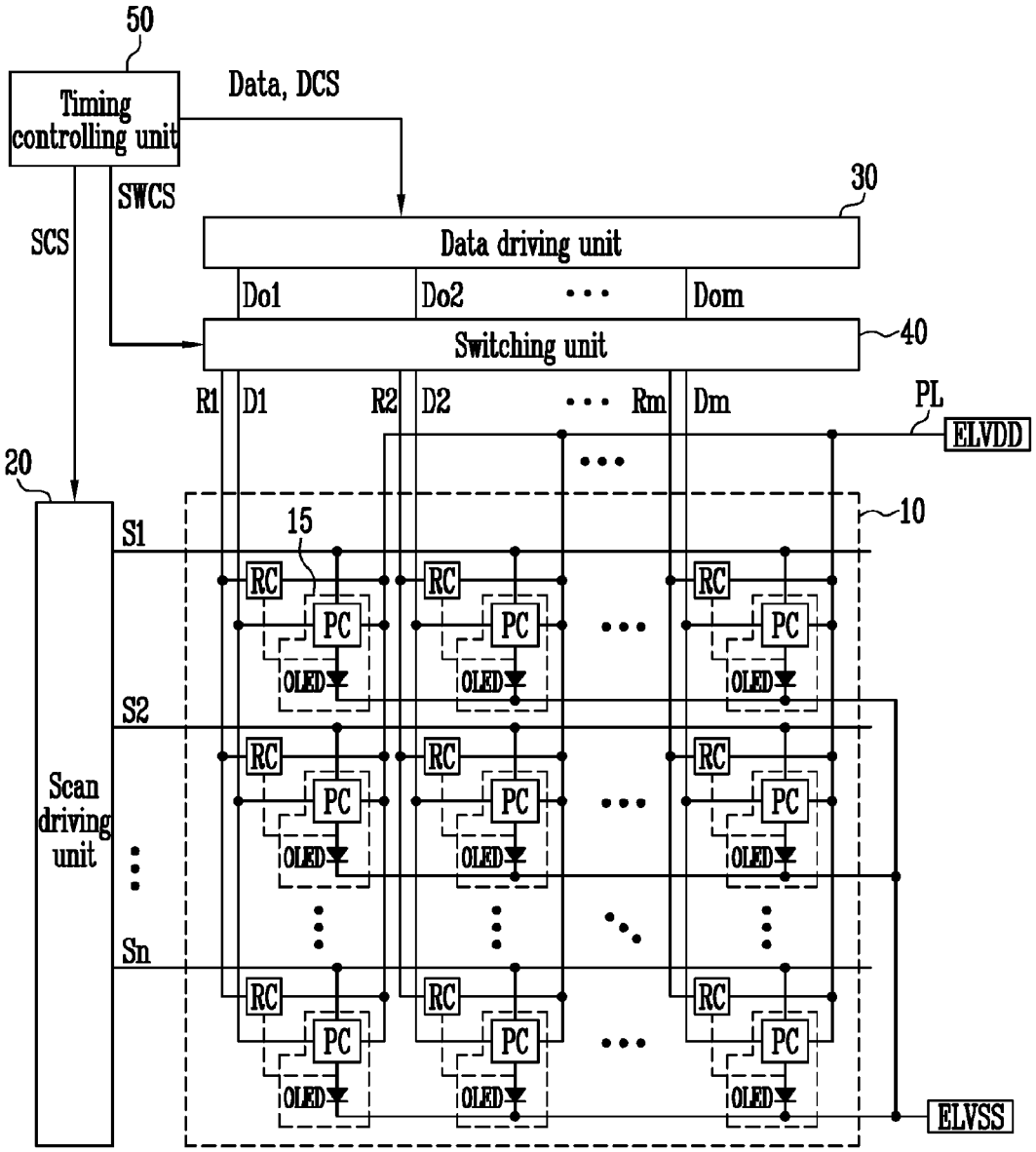
FIG. 1 depicts an embodiment of an OLED display.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, exemplary embodiments of the present invention will be described in detail with reference to the accompanying drawings.

Generally, the pixel circuit of an AMOLED display includes a driving transistor for controlling the driving current supplied to the organic light emitting diode, a switching transistor for transferring the data signal to the driving transistor, and a storage capacitor for maintaining a voltage of the data signal. In addition, the pixel circuit often includes more electronic devices including a transistor to compensate a threshold voltage of the driving transistor and a transistor to transfer an initializing voltage to the pixel circuit.

Figure 2:
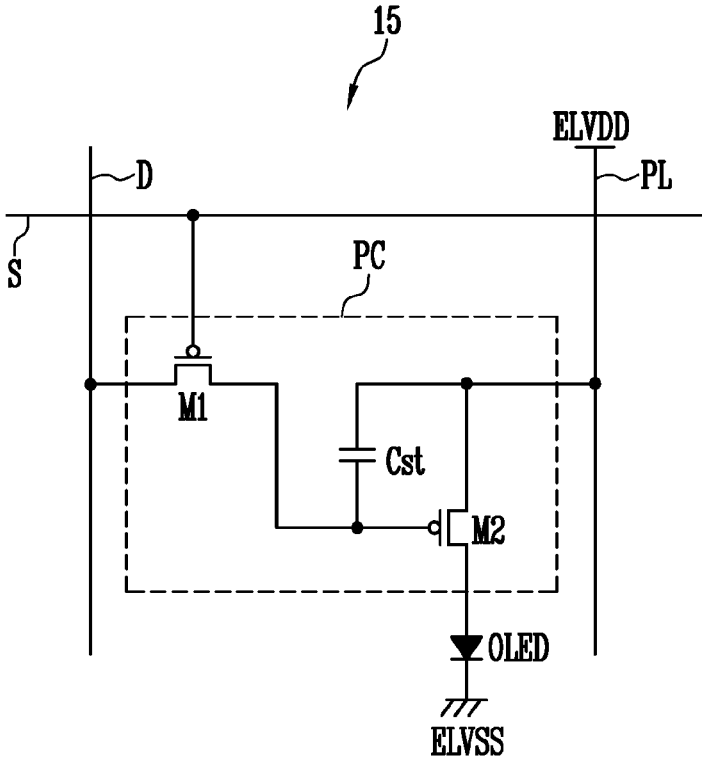
FIG. 2 depicts an embodiment of a pixel shown in FIG. 1.

FIG. 1 is a view showing an OLED display according to an exemplary embodiment. FIG. 2 is a view showing an example of the pixel shown in FIG. 1.

First, referring to FIG. 1, an OLED display includes a pixel unit 10. The pixel unit 10 includes a plurality of pixels 15 positioned at the intersection of scanning lines S, data lines D, and power lines PL. The OLED display also includes a scan driving unit 20 for supplying a scanning signal to the scanning lines S, a data driving unit 30 for supplying a data signal to the data lines D, a switching unit 40 disposed between the pixel unit 10 and the data driving unit 30, and a timing controlling unit 50 for controlling the scanning driving unit 20, the data driving unit 30, and the switching unit 40. In some embodiments, the OLED display further includes repair lines R disposed in a direction in parallel with the data lines D, and repair circuits RC connected to the repair lines R and power lines PL.

The pixel unit 10 includes a plurality of pixels disposed in a matrix formed at the intersection of the scanning lines S1, S2, . . . Sn, the data lines D1, D2, . . . Dm, and the power lines PL. The pixel unit 10 receives a first and a second pixel powers ELVDD, ELVSS for driving from an external power circuit (not shown), and a scanning signal and a data signal from the scanning lines S1, S2, . . . Sn and the data lines D1, D2, . . . Dm, respectively. The pixel unit 10 received the first and the second pixel powers ELVDD, ELVSS the scanning signal, and the data signal, and displays an image corresponding to the data signal.

Each of the pixels 15 includes a pixel circuit PC connected to the horizontal scanning lines S1 to Sn, the vertical data lines D1 to Dm, and the power lines PL. The pixel 15 is disposed and in the area bounded by the scanning lines and the data lines. An OLED connected to the pixel circuit PC for each pixel 15. In some embodiments, the scanning lines may be disposed vertically and the data lines may be formed horizontally. The scanning and data lines may be arranged in other patterns, such as a diamond pattern, or any other logical or suitable pattern.

The pixel circuit PC supplies a driving current corresponding to the data signal supplied to the data line D to the OLED when the scanning signal is supplied to the scanning line S. As used herein, the first electrode of a transistor is defined as any one of a source electrode and a drain electrode, and the second electrode is defined as a different electrode from the first electrode. For example, if the first electrode is the source electrode, the second electrode is the drain electrode.

Referring to FIG. 2, the pixel circuit PC includes a first transistor M1 connected to the scanning line S, the data line D, and a second transistor M2. The second transistor M2 connected between the first pixel power ELVDD and the OLED. A storage capacitor Cst connected between a gate electrode and a first electrode of the second transistor M2.

The gate electrode of the first transistor M1 is connected to the scanning line S, and the first electrode thereof is connected to the data line D. Further, the second electrode of the first transistor M1 is connected to a side terminal of the storage capacitor Cst. The first transistor M1 is turned-on when the scanning signal is supplied from the scanning line S, which supplies the data signal the data line D to the storage capacitor Cst. Then, the voltage corresponding to the data signal is charged to the storage capacitor Cst.

The gate electrode of the second transistor M2 is connected to a terminal of the storage capacitor Cst, and the first electrode is connected to the other terminal of the storage capacitor Cst and the first pixel power ELVDD. The second electrode of the second transistor M2 is connected to an anode electrode of the OLED. The second transistor M2 controls the driving current flowing to the second pixel power ELVSS via the OLED from the first pixel power ELVDD, which corresponds to the voltage value stored in the storage capacitor Cst. The OLED generates light corresponding to the driving current supplied from the second transistor M2.

Although FIG. 2 shows a structure in which the pixel circuit PC is configured having only with the first and the second transistors, M1 and M2, and the storage capacitor Cst, the present invention is not limited thereto. Other configurations having other transistors or capacitors may be used without departing from the scope of the present disclosed technology. For example, the pixel circuit PC may further include various electronic devices such as a transistor for threshold compensation of compensating a threshold voltage of the second transistor M2 and a transistor for initializing and transferring an initializing voltage.

With the pixel circuit PC including at least one capacitor C and a plurality of transistors M, the risk of a defect in the pixel circuit PC increases. In the case where the defect is in the pixel circuit PC, the pixel 15 will operate abnormally, for example, the OLED may emit no light, or may over-emit light. In some embodiments, the pixel circuit PC does not smoothly supply a driving current or supply an over current to the OLED display.

Particularly, in the case the pixel 15 over emits, the defect is easily recognized by a user, visible as a bright spot in the OLED display. Therefore, according to the related art, the pixel 15 is simply repaired by cutting a cathode electrode of the OLED so as to blacken the pixel 15. However, by doing so, the pixel 15 defect is not corrected, and the pixel is simply changed to a blind spot. Thus, the light generated by the pixel 15 may not have a desired luminance.

Accordingly, in some embodiments, the OLED display includes a repair circuit so that the light of the desired luminance may generate from the corresponding pixel 15 when a defect exists in the pixel circuit PC.

As shown in FIG. 1, the repair circuit RC is disposed close to pixels 15, and connected to the repair line R and the power line PL. Here, the repair line R is disposed in parallel with data line D side by side. For example, in some embodiments, there is a repair lines R corresponding to each of the data lines D for each pixel column.

In some embodiments, there is a repair circuits RC provided for each pixel 15 in FIG. 1. The repair circuits RC are disposed in the pixel unit 10 so that each repair circuit RC is disposed close to a pixel 15. That is, there may be one repair circuit RC corresponding to only one pixel 15. The present disclosure is not necessarily limited thereto. For example, in some embodiments, there may be one repair circuit RC for every two pixels, or any other suitable ratio. A plurality of the pixels 15 may also be configured to share one repair circuit RC. As an example, the plurality of the pixels 15 which are disposed to the same column may be configured to share the one repair circuit RC. In this case, a position of the repair circuits RC may be variously changed like the repair circuits RC are provided in the pixel unit 10 or an upper portion and/or a lower portion of the pixel unit 10.

In the case in which the defect occurs in the pixel circuit PC, the repair circuit PC supplies the driving current to the OLED instead of the pixel circuit PC in which a defect is occurred. A detailed description of a configuration and an operation of the repair circuits RC will be described below.

The scan driving unit 20 generates the scanning signal corresponding to a scanning control signal SCS supplied from the timing controlling unit 50, and supplies the scanning signal to the scanning lines S1 to Sn. When the scanning signals are supplied to the scanning lines S1 to Sn, the pixels 15 are selected in a horizontal line unit.

The data driving unit 30 generates the data signal corresponding to a data controlling signal DCS and data supplied from the timing controlling unit 50, and supplies the data signal to the data lines D11 to Dm. The data driving unit 30 can supply a high potential voltage like the first pixel power ELVDD to output lines Do1, Do2, . . . Dom, during an initial period of a non-light emitting period of the pixels 15 which are disposed in the corresponding horizontal line, and supplies the data signal to the output lines Do1 to Dom during the initial period of an light-emitting period of the pixels 15.

The switching unit 40 is disposed between the pixel unit 10 and the data driving unit 30 to selectively connect the output lines Do1 to Dom of the data driving unit 30 to either the repair lines R or the data lines D. To this end, the switching unit 40 may include a plurality of switches connected among the repair lines R, the data lines D, and the output lines Do of the data driving unit 30. As an example, the switching unit 40 may receive a switching control signal SWCS from the timing control unit 50 so as to be controlled by the timing control unit 50.

The timing control unit 50 supplies and controls the control signal SCS, DCS, SWCS to the scanning driving unit 20, the data driving unit 30, and the switching unit 40 to transfer a data supplied from the outside to the data driving unit 30.

Figure 3:
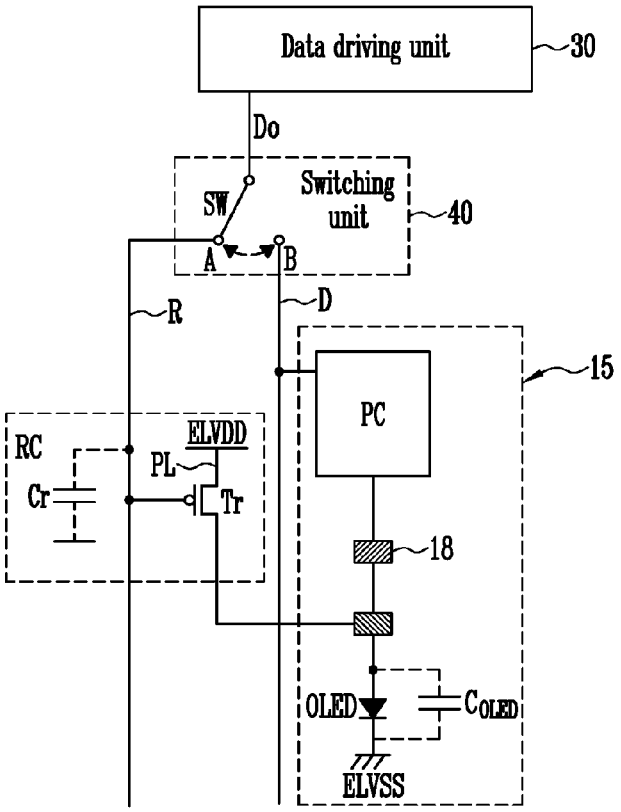
FIG. 3 depicts an embodiment of the repair circuit and the switching unit shown in FIG. 1.
Figure 4:
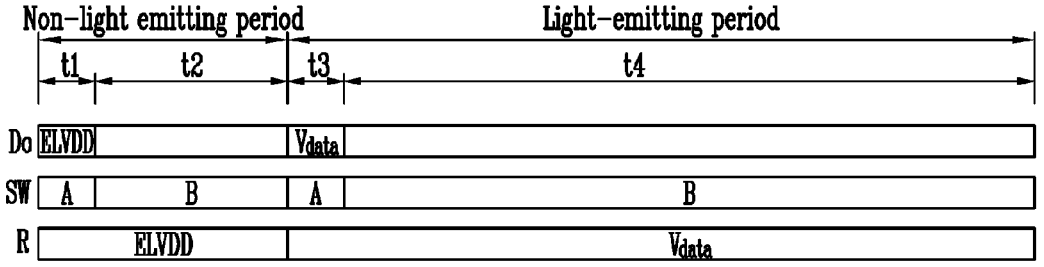
FIG. 4 shows a driving method of the repair circuit and the switching unit shown in FIG. 3.

FIG. 3 is a view showing an example of the repair circuit and the switching unit shown in FIG. 1. FIG. 4 is a view showing a driving method of the repair circuit and the switching unit shown in FIG. 3.

The OLED display according to an exemplary embodiment includes the repair circuits RC to supply the driving current to the OLED instead of the pixel circuit PC in the case in which a defect is occurred in the pixel circuit PC. According to this, even in the case in which a defect is occurred in the pixel circuit PC, the light having the desired luminance in the corresponding pixel 15 may be generated to thereby improve the yield.

For convenience, FIGS. 3 and 4 show only a single pixel, a repair circuit connected to the pixel, and a switch. An operation thereof will be described below. In some embodiments, a plurality of repair lines and a repair circuits are included in the pixel unit, and a plurality of switches may be included in a switching unit for selectively connecting each output line of the data driving unit to the data line or the repair line of the corresponding column.

First, referring to FIG. 3, the switching unit 40 includes a switch SW for selectively connecting an output line Do of the data driving unit 30 to the repair line R or the data line D. The repair circuit RC includes a transistor Tr in which the gate electrode is connected to the repair line R, the first electrode is connected to the power line PL, and the second electrode is connected or floated to the OLED in the adjacent pixel 15.

The transistor Tr maintains a state in which it is separated from the OLED when the pixel circuit supplies a normal driving voltage to the OLED as during normal operation. In the case in which the defect is occurred in the pixel circuit PC, the transistor Tr supplies the driving current corresponding to the data signal to the OLED by being connected to the OLED, instead of the pixel circuit PC which a defect is occurred.

That is, in case a defect is generated in the pixel circuit PC, the transistor Tr cuts the connection between the pixel circuit PC and the OLED, and the OLED display is provided by connecting the OLED to the adjacent repair circuit RC disposed in the same column. In this case, the pixel circuit PC and the OLED display are electronically separated each other by a cutting area 18.

The capacitor Cr equivalently shows the capacitance generated in the repair line R, and $C_{OLED}$ equivalently shows the capacitance generated in the OLED.

Hereinafter, the operation of the switching unit and the repair circuit shown in FIG. 3 will be described with reference to FIGS. 3 and 4. Particularly, the driving method of the pixel 15 will be described assuming that the connection between the pixel circuit PC and the OLED is cut and the OLED is driven by the repair circuit RC.

First, as shown in FIG. 4, the data driving unit 30 outputs the first pixel power ELVDD to the output line Do during at least initial period of the non-light emitting period of the corresponding pixel 15, that is, the first period t1. Then, during the first period t1, the switch SW provided in the switching unit 40 connects the output line Do of the data driving unit 30 to the repair line R. The repair line R is charged with the voltage of the first pixel power ELVDD, and the first transistor Tr is turned off by the voltage of the first pixel power ELVDD applied to the repair line R. If the first transistor Tr is turned off, the OLED is set to the non-light emitting state by blocking the supply of the driving current to the OLED.

Although an example that the data driving unit 30 outputs the voltage of the first pixel power ELVDD to the output line Do is described in FIG. 4, the present disclosure is not necessarily limited thereto. That is, during the first period t1, the data driving unit 30 outputs voltage is blocked to the OLED, that is, the voltage which the transistor Tr in the repair circuit RC is turned off to the output line Do.

Then, during the remainder of the non-light emitting period, or, the second period t2, the switch SW provided in the switching unit 40 connects the output line Do of the data driving unit 30 to the data line D. During the second period t2, the data driving unit 30 may drive the other pixels (for example, the pixels disposed in the other horizontal line) of the pixel unit. In this case, although the repair line R connected to the repair circuit Rc is in a floating state, since the capacitance Cr generated in the repair line R is high, the voltage of the gate electrode of the transistor Tr maintains the voltage of the first pixel power ELVDD. Accordingly, the turned off state of the transistor Tr is maintained and the OLED maintains the non-light emitting state.

Then, during the initial period of the light emitting period of the corresponding pixel 15, that is, the third period t3, the data driving unit 30 supplies the data signal Vdata of the pixel 15 to the output line Do, and the switch SW provided in the switching unit 40 connects the output line Do of the data driving unit 30 to the repair line R. According to this, the repair line R is charged with the voltage of the data signal Vdata, and the voltage of the data signal Vdata is applied to the gate electrode of the transistor Tr, such that the driving voltage corresponding to the data signal Vdata flows from the first pixel power ELVDD to the second pixel power ELVSS via the transistor Tr and the OLED. Accordingly, during the third period t3, the OLED emits light having a luminance corresponding to the data signal Vdata.

Then, during rest of the light-emitting period, that is a fourth period t4, the switch SW disposed the switching unit 40 connects the output line Do of the data driving unit 30 to the data line D and the data driving unit 30 normally operates the other pixels of the pixel unit. In this case, even if the repair line R connected with the repair circuit RC is changed to the floating state, the voltage of the gate electrode of the transistor Tr is maintained at the voltage of the data signal Vdata by the capacitance Cr of the repair line R. Thus, the OLED maintains the light emitting state of the third period t3 during the fourth period t4 as well.

That is, the present invention includes the repair circuit RC capable of maintaining the light-emitting state in the case in which the defect is generated in the pixel circuit PC. And the OLED of the pixel 15 in which the defect is generated is driven by connecting to the repair circuit RC including the transistor Tr connected between the OLED and the first pixel power ELVDD in the pixel circuit PC.

As described above, the driving method of the OLED by the repair circuit RC, includes applying the voltage to the gate electrode of the transistor Tr to turn off the transistor Tr during the non-light emitting period of the pixel 15. The driving method further includes applying the voltage corresponding to the data signal Vdata to the gate electrode of the transistor Tr during the light-emitting period of the pixel 15.

In some embodiments, during at least the initial period of the non-light emitting period of the pixel 15, that is, the first period t1, the repair line R, connects to the output line Do of the data driving unit 30 and outputs voltage to turn off the transistor Tr during the first period t1.

Further, the repair line R connects to the output line Do of the data driving unit 30 and the data signal is outputted during at least the third period t3.

According to the exemplary embodiment, the repair circuit RC supplies the driving current corresponding to the data signal Vdata to the OLED instead of the pixel circuit PC if the defect is in the pixel circuit PC, such that the pixel may be able to operate normally.

That is, a pixel defect may be corrected using a simple repair process which includes separating the pixel circuit PC, in which a defect has occurred, from the OLED connected to the pixel circuit, and connecting the OLED to the adjacent repair circuit RC. Thus, the yield of product may be improved.

Figure 5:
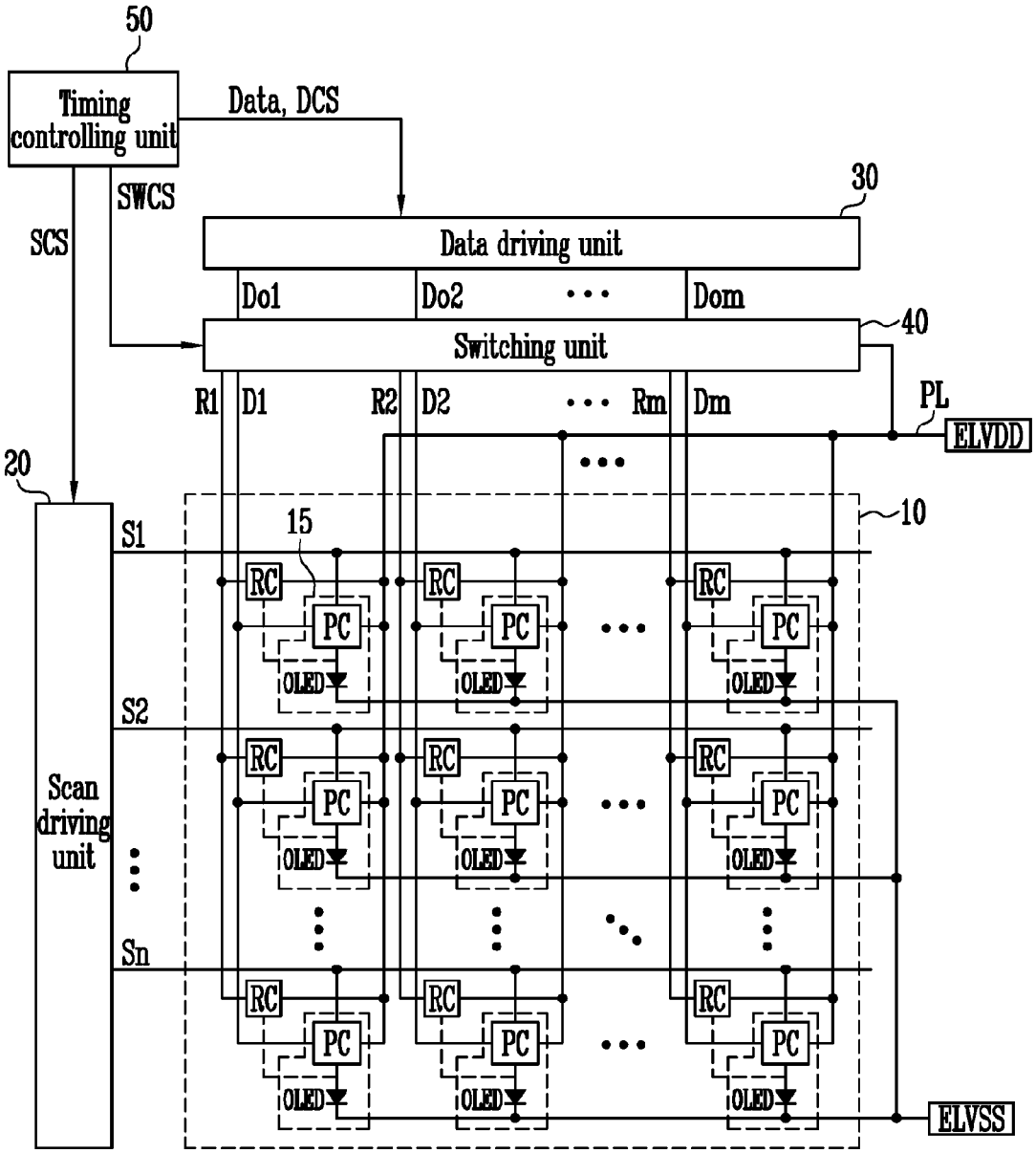
FIG. 5 depicts an embodiment of an OLED.
Figure 6:
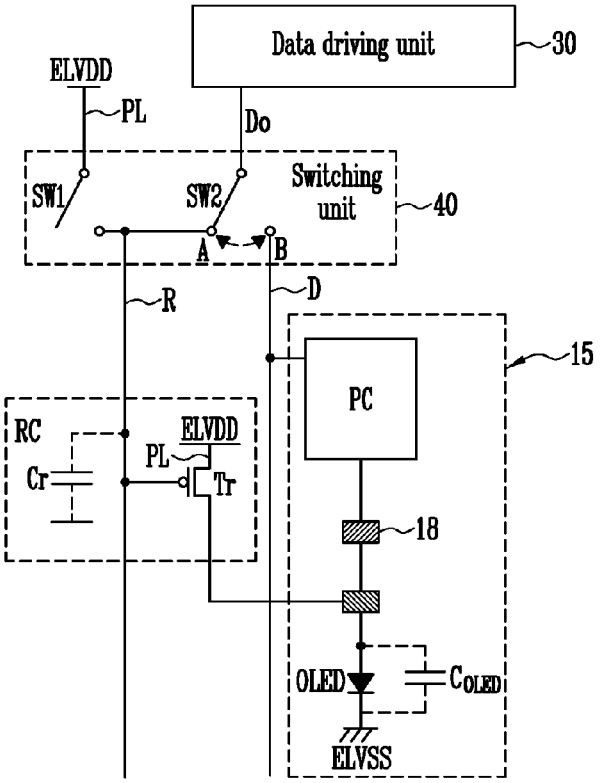
FIG. 6 depicts an embodiment of the repair circuit and the switching unit shown in FIG. 5.

FIG. 5 is a view showing an OLED display according to another exemplary embodiment. FIG. 6 is a view of an example of the switching unit and the repair circuit shown in FIG. 5, and FIG. 7 is a view of showing the driving method of the switching unit and the repair circuit shown in FIG. 6.

Figure 7:
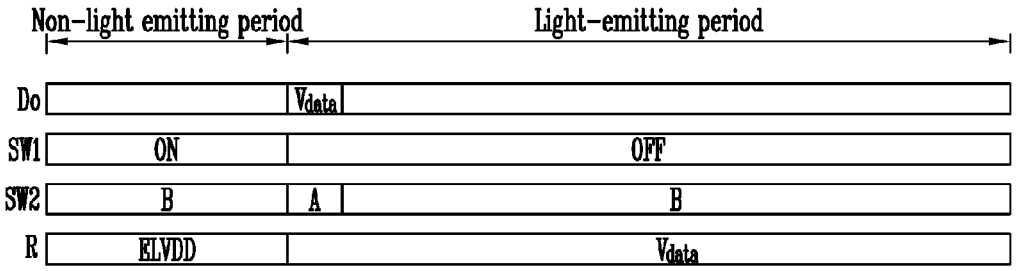
FIG. 7 shows a driving method of the repair circuit and the switching unit shown in FIG. 6.

For convenience, in FIGS. 5 to 7, the same reference numerals denote the same or similar portions with FIGS. 1 and 3 to 4. Therefore, a detailed description thereof will be omitted.

First, referring to FIG. 5, the power line PL is connected inside the switching unit 40, according to this, the first pixel power ELVDD is supplied from the switching unit 40. Although the first pixel power ELVDD is supplied to the switching unit 40, the present development is not limited thereto. For example, other power having a voltage sufficient to turn off the transistor Tr of the repair circuit RC may be supplied to the switching unit 40.

Referring to FIG. 6, the switching unit 40 includes a first switch SW1 for controlling a connection between the power line PL and the corresponding repair line R and a second switch SW2 for selectively connecting the corresponding output line Do of the data driving unit 30 to the repair line R or the data line D of the corresponding line.

Meanwhile, although one pixel 15, one repair circuit RC connected to the pixel, and one of the first and the second switch SW1, SW2 for supplying the first pixel power ELVDD or the data signal Vdata to the repair circuit RC is shown in FIG. 6, a plurality of the first and the second switch SW1, SW2 may be produced as many as the number of lines of the pixels 15 disposed in the pixel unit 10.

The first switch SW1 on the line of pixel 15 is turned on at the non-emitting period of the pixel 15 and turned off at the emitting period of the pixel 15 as shown in FIG. 7.

The second switch SW2 on the line of the pixel 15 connects the corresponding output line Do of the data driving unit 30 to the corresponding repair line R at the initial period of light-emitting period of the pixel 15 and connects the corresponding output line Do of the data driving unit 30 to the corresponding data line D at the remainder of the light-emitting period of the pixel 15 and non-emitting period.

Accordingly, the voltage of the first pixel power ELVDD is applied from the power line PL to the repair line R via the first switch SW1. According to this, the transistor Tr inside the repair circuit RC is turned off so that the driving current to the OLED is blocked, and the OLED is set to the non-emitting state.

The output line Do of the data driving unit 30 is connected to the repair line R through the second switch SW2 at the initial period of the emitting period of the pixel 15, and the data driving unit 30 outputs the data signal Vdata of the pixel during this period. The voltage of the data signal Vdata is applied to the gate electrode of the transistor Tr, and the driving current corresponding to the data signal Vdata flows from the first pixel power ELVDD to the second pixel power ELVSS via the OLED. Accordingly, the OLED emits light having a luminance corresponding to the data signal Vdata.

Then, although the second switch SW2 normally operates other pixels by connecting the output line Do of the data driving unit 30 to the data line D, the voltage of the gate electrode of the transistor Tr maintains the voltage of the data signal Vdata by the capacitance Cr of the repair line R. According to this, the OLED emits the light having the luminance corresponding to the data signal Vdata during the light emitting period.

As set forth above, in the case where the defect is in the pixel circuit, the repair circuit is provided to supply the driving current corresponding to the data signal to the organic light emitting diode instead of the pixel circuit, It will allow the repair circuit to generate the desired signal to the corresponding pixel even in the case in which the defect is generated in the pixel circuit. Therefore, the yield of the OLED display may be improved.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting diode display, comprising:

a pixel unit comprising a plurality of pixels positioned at the intersection of scan lines, data lines, and power lines, wherein each of the pixels comprises a pixel circuit connected to a corresponding scan line, data line, and power line, and an organic light emitting diode;

repair lines placed in parallel with the data lines;

repair circuits connected to the repair lines and the power lines;

a scanning driving unit configured to supply a scanning signal to the scan lines;

a data driving unit configured to supply a data signal to the data lines, a switching unit configured to selectively connect output lines of the data driving unit to the repair lines or the data lines and selectively disconnect the output lines from the repair lines or the data lines, wherein the switching unit is further configured to repeatedly perform the selective connection and disconnection in response to a switching control signal received from a timing controller.

2. The display device of claim 1, wherein each of the repair circuits includes a transistor, wherein a gate electrode of the transistor is connected to a corresponding repair line, a first electrode of the transistor is connected to a corresponding power line, and a second electrode of the transistor is connected to the organic light emitting diode.

3. The display device of claim 1, wherein the switching unit is configured to electrically separate the pixel circuit from the data driving unit when a defect is present in the pixel.

4. The display device of claim 3, wherein, when a defect is present in the pixel, the switching unit is further configured to connect the organic light emitting diode to an adjacent repair circuit.

5. The display device of claim 4, wherein the switching unit comprises switches configured to selectively connect each output line of the data driving unit to the repair line or the data line, during an initial portion of a non-light emitting period and during initial portion of a light-emitting period of the pixel.

6. The display device of claim 5, wherein the data driving unit is further configured to output i) a power supply voltage during the initial portion of the non-light emitting period of the pixel and ii) a data signal to the corresponding output line during the initial portion of the light-emitting period of the pixel.

7. The display device of claim 4, wherein the switching unit comprises first switches configured to control a connection between the power line and the corresponding repair line, and second switches configured to selectively connect each output line of the data driving unit to either the repair line or the data line of the corresponding column.

8. The display device of claim 7, wherein, if a defect is present in the pixel, the first switches of the column are further configured to connect the power supply voltage to the repair line during the non-light emitting period of the pixel, and the second switches are further configured to connect the output lines of the data driving unit to i) the repair line during the initial portion of the light emitting period of the pixel and ii) the data line during the remaining portion of the light-emitting period.

9. The display device of claim 8, wherein the data driving unit is further configured to output a data signal of the pixel during the initial period of the light-emitting period of the pixel.

10. The display device of claim 1, wherein the number of repair circuits are the same as the number of pixels in the display device, and wherein each repair circuit corresponds to one pixel.

11. The display device of claim 1, wherein one repair circuit corresponds to a group of more than one pixel, and wherein the group shares the one repair circuit.

12. The display device of claim 11, wherein the pixels sharing the one repair circuit are disposed in the same column.

13. A method of driving an organic light emitting display by connecting an organic light emitting diode of a pixel in which defect has occurred, the method comprising:

providing a repair circuit comprising a transistor connected between a first pixel power and the organic light emitting diode;

applying a voltage to the gate electrode of the transistor sufficient to turn off the transistor during a non-light emitting period of the pixel;

applying a signal voltage to the gate electrode of the transistor corresponding to a data signal of the pixel during a light-emitting period of the pixel; and selectively connecting output lines of a data driving unit to a repair line electrically connected to the repair circuit or a data line electrically connected to the pixel; and selectively disconnecting the output lines from the repair lines or the data lines, wherein the selectively connecting and disconnecting are repeatedly performed in response to a switching control signal received from a timing controller.

14. The method of claim 13, further comprising applying a power supply voltage to the repair line during at least an initial period of the non-light emitting period.

15. The method of claim 14, wherein the power supply voltage is sufficient to turn off the transistor.

16. The method of claim 14, further comprising applying the data signal to the repair line during at least an initial period of the light-emitting period of the pixel.

* * * * *